US011052517B2

(12) United States Patent
Hsieh

(10) Patent No.: US 11,052,517 B2
(45) Date of Patent: Jul. 6, 2021

(54) TORQUE TOOL FOR IDENTIFYING LOCKING STATE OF TORQUE ADJUSTMENT MECHANISM

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 341 days.

(21) Appl. No.: 16/297,242

(22) Filed: Mar. 8, 2019

(65) Prior Publication Data

US 2019/0344410 A1 Nov. 14, 2019

(30) Foreign Application Priority Data

May 8, 2018 (TW) ..... 107115609

(51) Int. Cl.
*B25B 23/142* (2006.01)
*B25B 23/00* (2006.01)
*B25B 23/16* (2006.01)

(52) U.S. Cl.
CPC ..... *B25B 23/1427* (2013.01); *B25B 23/0007* (2013.01); *B25B 23/16* (2013.01)

(58) Field of Classification Search
CPC . B25B 23/141; B25B 23/142; B25B 23/1422; B25B 23/1427; B25B 23/0007; B25B 23/16
See application file for complete search history.

(56) References Cited

U.S. PATENT DOCUMENTS 8,495,935 B2 * 7/2013 Mountz ..... G01L 5/24 81/467
8,763,500 B2 * 7/2014 Mountz ..... B25B 23/1427 81/467
9,056,391 B1 * 6/2015 Wu ..... B25G 1/105
10,702,979 B2 * 7/2020 Chen ..... B25B 23/0007

* cited by examiner

*Primary Examiner* — David B. Thomas
(74) *Attorney, Agent, or Firm* — Guice Patents PLLC

(57) ABSTRACT

A torque tool for identifying locking state of torque adjustment mechanism includes: a tubular body; a tool head having a stem body fitted in the tubular body, a torque adjustment mechanism being used to adjust the torque of the torque tool, a handle with at least one display window being fitted around the tubular body; a locking mechanism for selectively locking the torque adjustment mechanism; a push unit positioned behind the locking mechanism; and a first identification area and a second identification area respectively formed on the locking mechanism and the push unit. When the locking mechanism is not pushed by the push unit, the first identification area is displayed through the display window. When the push unit pushes the locking mechanism to lock the torque adjustment mechanism, it is impossible to adjust the torque of the torque tool and the second identification area is displayed through the display window.

11 Claims, 7 Drawing Sheets

TORQUE TOOL FOR IDENTIFYING LOCKING STATE OF TORQUE ADJUSTMENT MECHANISM

BACKGROUND OF THE INVENTION

1. Field of the Invention

The present invention relates generally to a tool, and more particularly to a torque tool with identification areas displayed through display windows. A user can check whether the torque adjustment mechanism is locked or not by means of observing the identification areas through the display windows.

2. Description of the Related Art

A torque tool is used to tighten/untighten a threaded member. The set torque value of the torque tool can be adjusted so as to control the tightening extent of the threaded member. Especially to a special or important apparatus, the structures of the components of the apparatus necessitate precise and correct tightening extent. Therefore, the torque value of the torque tool is preset to tighten the sophisticated components of the apparatus in accordance with the necessary mechanical properties of the apparatus so as to meet the security regulation and ensure the normal operation of the apparatus.

The conventional torque tools can be substantially classified into two types, that is, electronic torque tool and mechanical torque tool. With respect to the mechanical torque tool, an elastic member is disposed in the torque tool to provide elastic force for creating torque. By means of a torque adjustment mechanism, the elastic member can be compressed or uncompressed to adjust the torque tool to a necessary torque value so that the torque tool can be used to precisely tighten/untighten various threaded members or components.

After the torque adjustment of the torque tool is completed, it is necessary to lock the torque adjustment mechanism with a locking structure so as to prevent the torque adjustment mechanism from being affected by external force to lead to change of the set torque value and cause torque value error. The torque adjustment mechanism can be locked to ensure the stability in use of the torque tool. However, most of the torque tools have no way for a user to know whether the torque adjustment mechanism has been locked by the locking structure. As a result, some users often use the torque tool with the torque adjustment mechanism unlocked. In this case, the adjusted torque value will change. Also, after the torque adjustment mechanism is locked by the locking structure, some users often check again whether the torque adjustment mechanism has been locked. This is quite troublesome and often leads to inconvenience in use of the torque tool.

SUMMARY OF THE INVENTION

It is therefore a primary object of the present invention to provide a torque tool for identifying locking state of torque adjustment mechanism. The torque tool has display windows for selectively displaying two identification areas so that a user can check whether the torque adjustment mechanism is locked or unlocked by means of observing the identification areas through the display windows.

To achieve the above and other objects, the torque tool for identifying locking state of torque adjustment mechanism of the present invention includes:

a tubular body;

a tool head fitting with a front end of the tubular body, the tool head having a stem body at a rear end, the stem body being disposed in the tubular body;

a click unit disposed in the tubular body, the click unit including a click block and an elastic body, the elastic body elastically abutting against a rear side of the click block, whereby the click block abuts against a rear end of the stem body by a pre-force;

a torque adjustment mechanism disposed in the tubular body and positioned behind the elastic body, the torque adjustment mechanism being movable in an axial direction of the tubular body to adjust the elastic force of the elastic body;

a tubular handle rotatably fitted around the tubular body, at least one display window being formed on a circumference of the handle, the handle serving to drive the torque adjustment mechanism;

a locking mechanism disposed between the torque adjustment mechanism and the handle for selectively locking the torque adjustment mechanism;

a push unit disposed in the handle and positioned behind the locking mechanism, the push unit being displaceable between an unlocking position and a locking position, when the push unit is positioned in the unlocking position, the torque adjustment mechanism being not locked by the locking mechanism, when the push unit is positioned in the locking position, the push unit driving the locking mechanism to lock the torque adjustment mechanism; and a first identification area and a second identification area respectively formed on the locking mechanism and the push unit, when the push unit is positioned in the unlocking position, the first identification area being displayed through the display window, when the push unit is positioned in the locking position, the second identification area being displayed through the display window.

When the torque adjustment mechanism is in locking state or unlocking state, the first identification area or the second identification area is displayed through the display windows. Therefore, a user can check whether the torque adjustment mechanism is locked or unlocked by means of observing the identification areas through the display windows. The identification of the present invention is novel and unique. Also, the adjusted torque value can be fixed to ensure the stability in use of the torque tool as the conventional torque tool. This enhances the utility of the torque tool.

The present invention can be best understood through the following description and accompanying drawings, wherein:

DETAILED DESCRIPTION OF THE PREFERRED EMBODIMENTS

Figure 1:
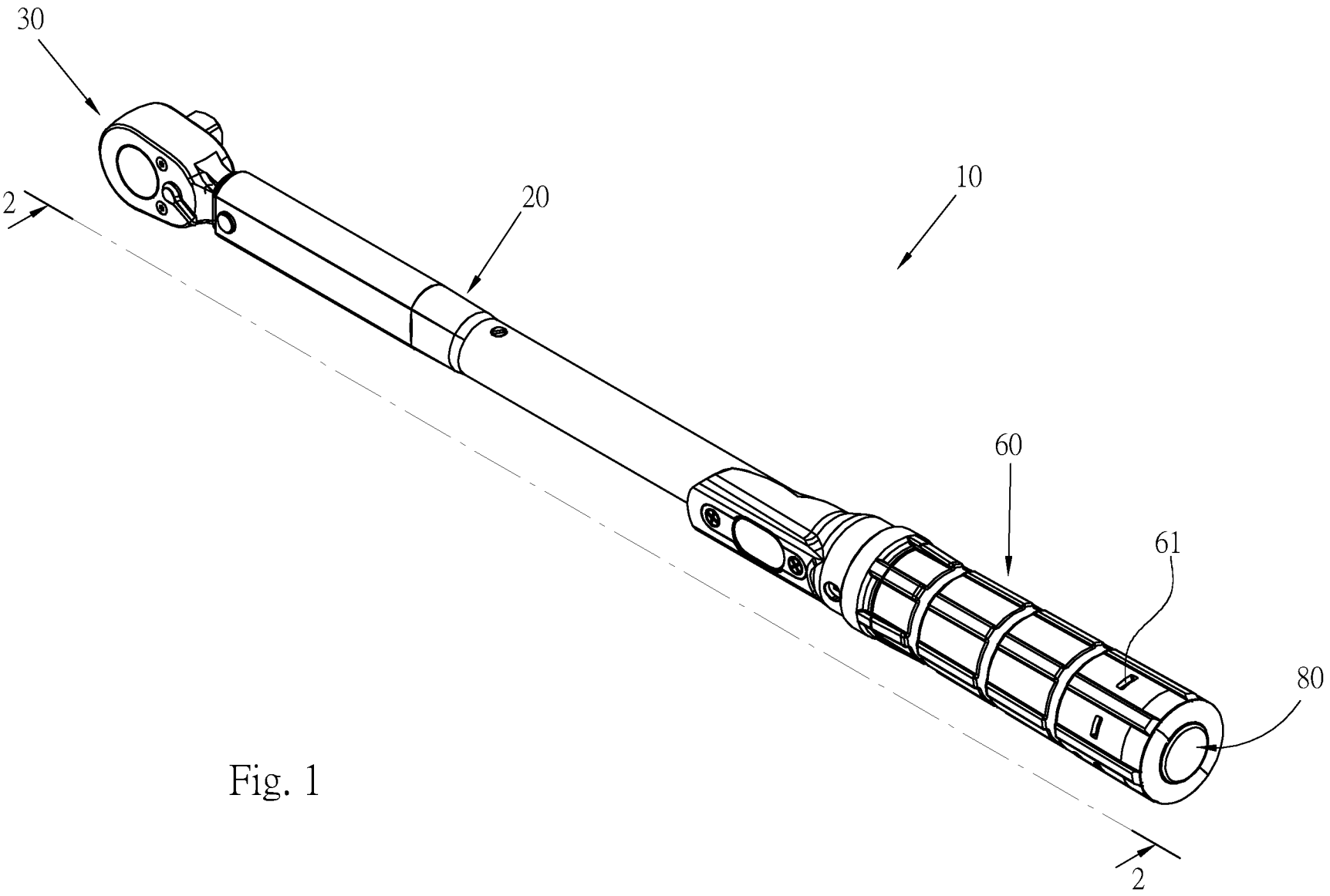
FIG. 1 is a perspective assembled view of a first embodiment of the torque tool of the present invention.
Figure 2:
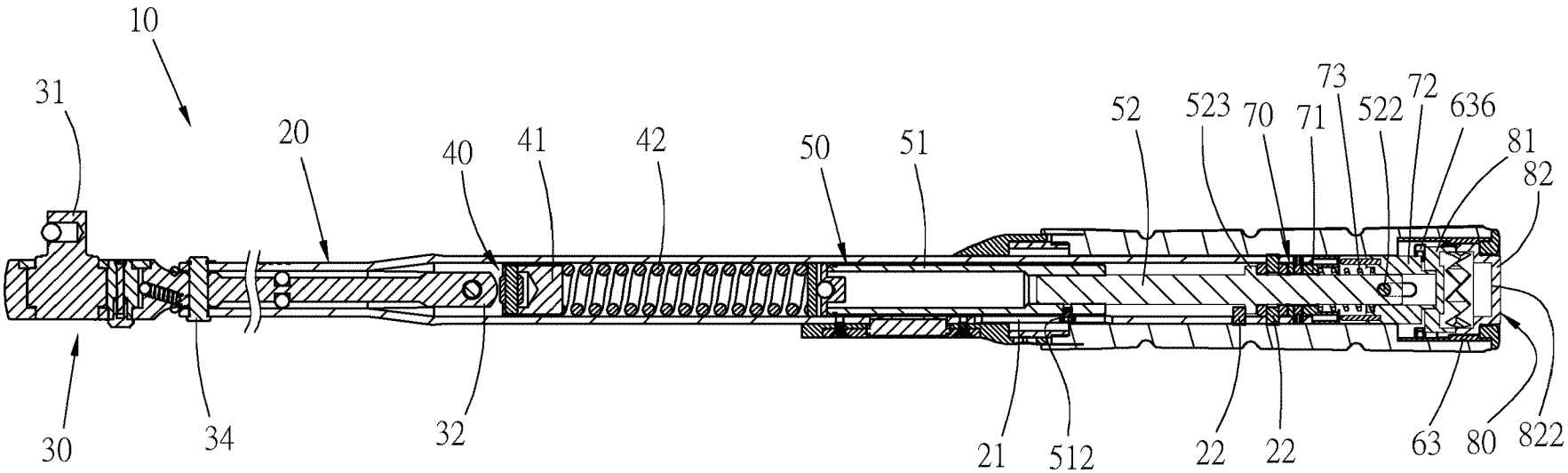
FIG. 2 is a sectional view taken along line 2-2 of FIG. 1.
Figure 3:
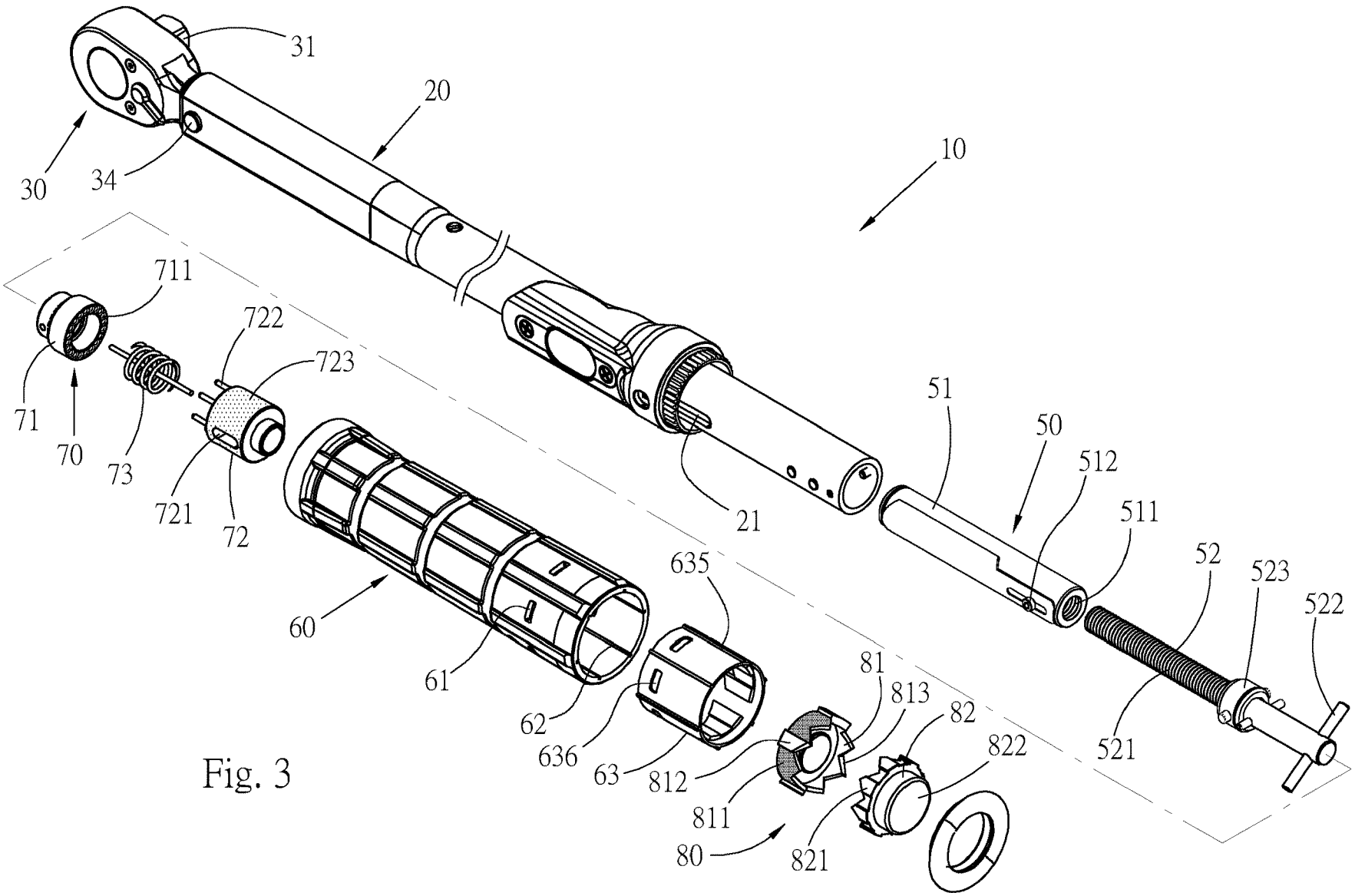
FIG. 3 is a perspective exploded view of the first embodiment of the torque tool of the present invention according to FIG. 1.
Figure 4:
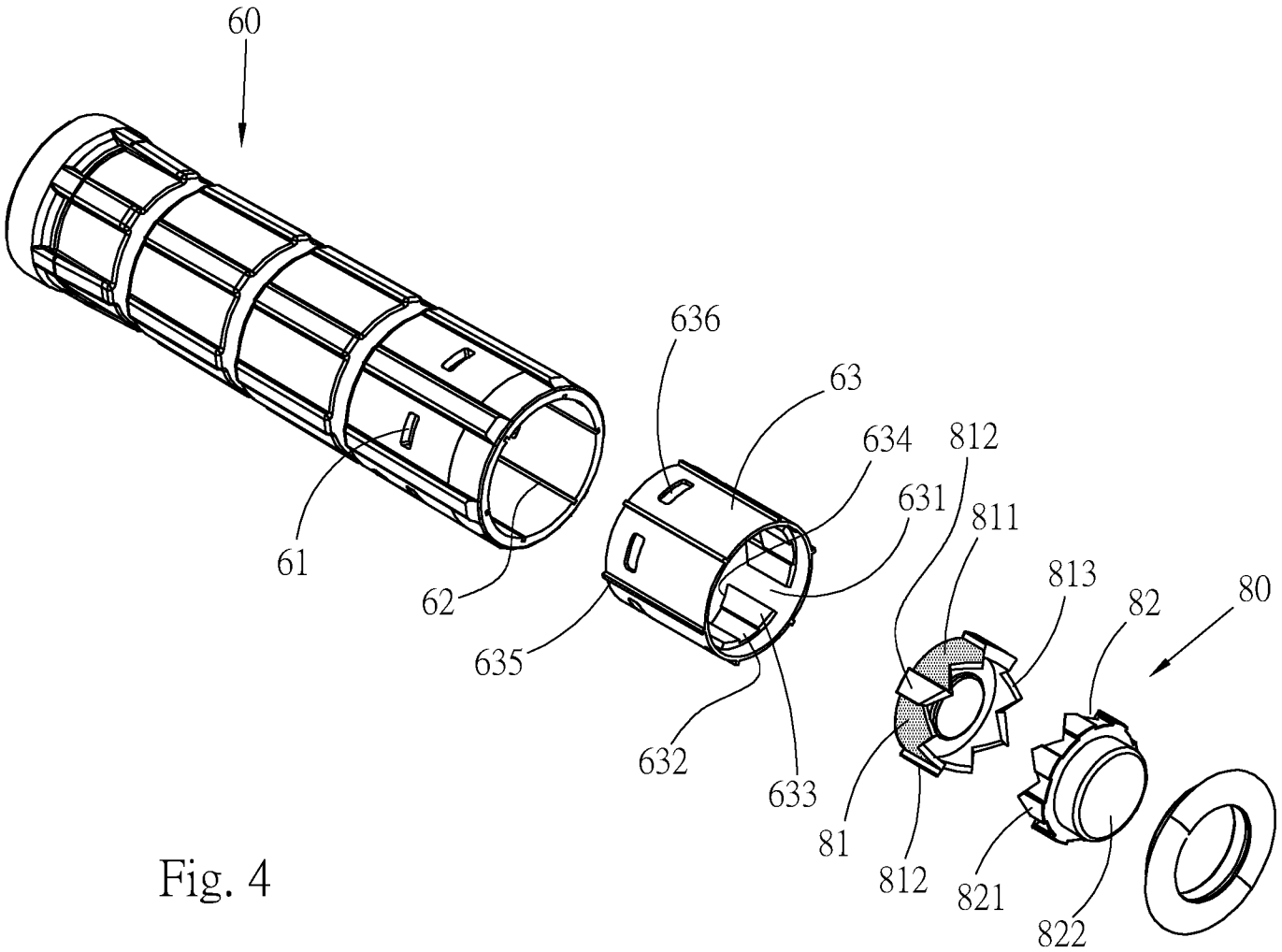
FIG. 4 is a perspective partially exploded view of the locking mechanism and the push unit of the first embodiment of the torque tool of the present invention according to FIG. 3.
Figure 5:
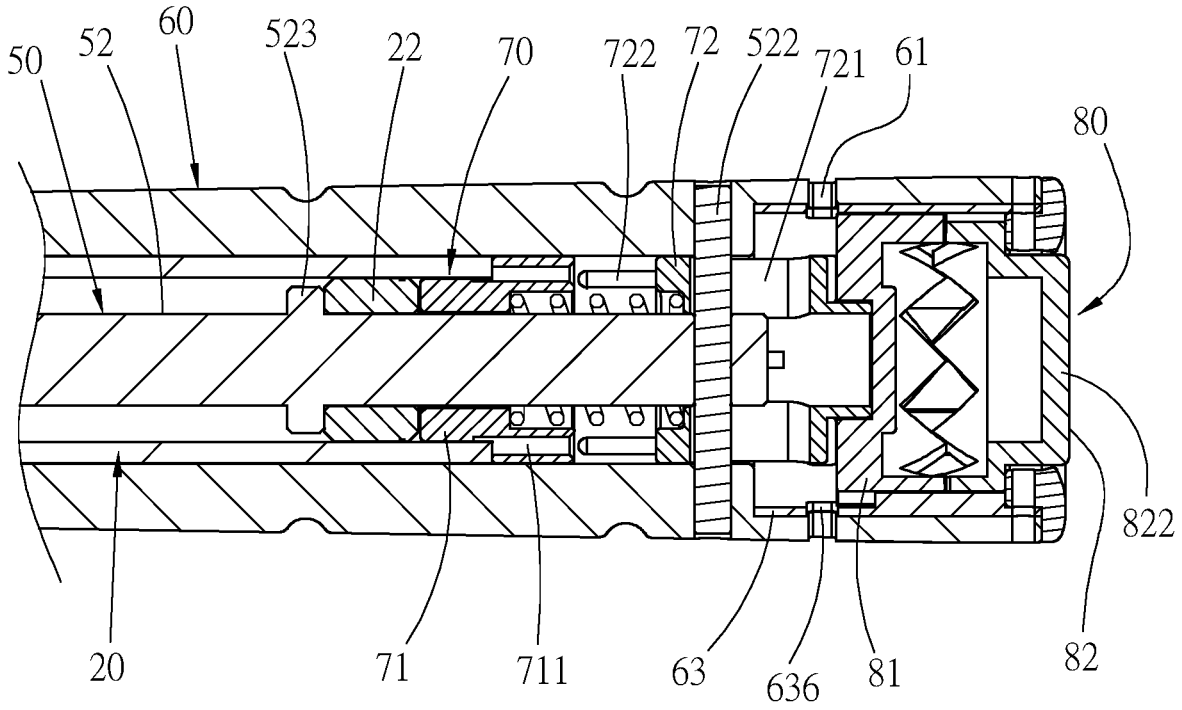
FIG. 5 is a sectional view showing the connection between the handle and the rotary rod of the first embodiment of the torque tool of the present invention.

Please refer to FIGS. 1 to 5, which show a first embodiment of the torque tool 10 for identifying locking state of torque adjustment mechanism of the present invention. In order to facilitate understanding of the technical content of the present invention, the front, rear, left, right, top and bottom sides referred to hereinafter are recited with reference to the direction of FIG. 1, not intended to limit the scope of the present invention. The torque tool 10 includes a tubular body 20, a tool head 30, a click unit 40, a torque adjustment mechanism 50, a tubular handle 60, a locking mechanism 70 and a push unit 80.

A guide slot 21 is formed at a rear end of the tubular body 20 and extends in an axial direction of the tubular body 20.

The tool head 30 has a head section 31 at a front end and a stem body 32 extending from a rear end of the head section into the tubular body 20. The stem body 32 is pivotally connected with the tubular body 20 via a pivot shaft 34. The head section 31 can drive a socket or a work piece. The head section 31 serves to drive a threaded member (such as a nut or a bolt) or a socket. The configuration of the head section 31 is not limited to the form as shown in the drawings.

The click unit 40 includes a click block 41 and an elastic body 42. The click unit 40 is disposed in the tubular body 20. The elastic body 42 elastically abuts against a rear side of the click block 41, whereby the click block 41 abuts against a rear end of the stem body 32 of the tool head 30 by a pre-force. When the applied force of the torque tool 10 reaches a set torque value, the click block 41 and the stem body 32 provide a click effect. This pertains to prior art and thus will not be redundantly described hereinafter.

The torque adjustment mechanism 50 is disposed in the tubular body 20, including a push member 51 and a rotary rod 52. The push member 51 is disposed behind the elastic body 42. A rear end of the push member 51 is formed with an inner thread section 511. A front end of the rotary rod 52 is formed with a threaded section 521 screwed in the inner thread section 511. A guide block 512 is disposed on an outer circumference of the push member 51 corresponding to the guide slot 21. The push member 51 is fitted into the tubular body 20, the guide block 512 is fitted in the guide slot 21, whereby the push member 51 can only axially displace within the tubular body 20. The displacement of the push member 51 will change the compression travel of the elastic body 42 so as to change the elastic force of the elastic body 42. A pin 522 is inserted through the rear end of the rotary rod 52. A restriction ring 523 is disposed on the rotary rod 52 behind the threaded section 521. The tubular body 20 has two restriction sections 22. After the rotary rod 52 is fitted into the tubular body 20, the two restriction sections 22 are positioned on the front side and the rear side of the restriction ring 523, whereby the axial move of the rotary rod 52 is restricted. Accordingly, when the rotary rod 52 is rotated, the push member 51 is linearly displaced.

The tubular handle 60 is fitted on the rear end of the tubular body 20. The pin 522 is inlaid in the handle 60, whereby the handle 60 can drive the rotary rod 52. Six display windows 61 are annularly formed through the rear end of the handle 60. Six longitudinal slide channels 62 are concavely formed on an inner circumference of the rear end of the handle 60 at equal intervals. A fitting collar 63 is fitted in the rear end of the handle 60. The fitting collar 63 is formed of a hollow socket. The inner circumference of the fitting collar 63 is formed with four passages 631 and four restriction protrusion blocks 632. A spacer block 633 is disposed between each passage 631 and each restriction protrusion block 632. The top section of the restriction protrusion block 632 is formed with a slope 634. Six slide ribs 635 are convexly disposed on the outer circumference of the fitting collar 63 corresponding to the slide channels 62, whereby the fitting collar 63 can be located in the rear end of the handle 60. Six assistant display windows 636 are formed through the top section of the fitting collar 63 in alignment with the display windows 61.

Figure 6:
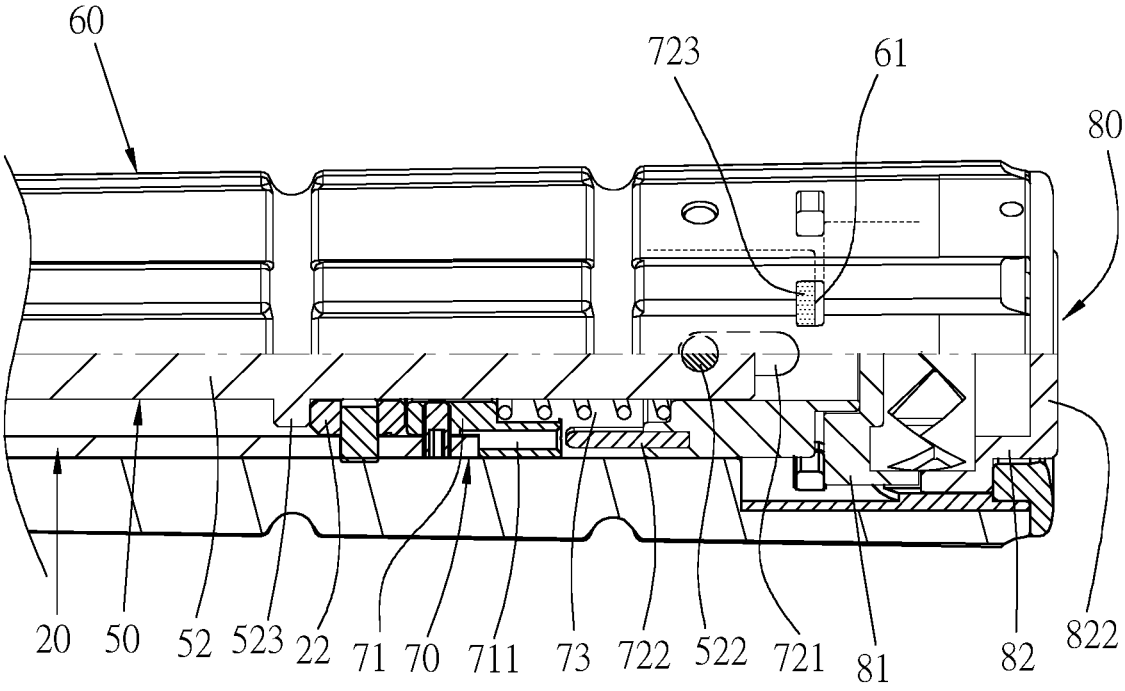
FIG. 6 is a partially sectional view of the first embodiment of the torque tool of the present invention, showing that the push unit is positioned in the unlocking position.
Figure 7:
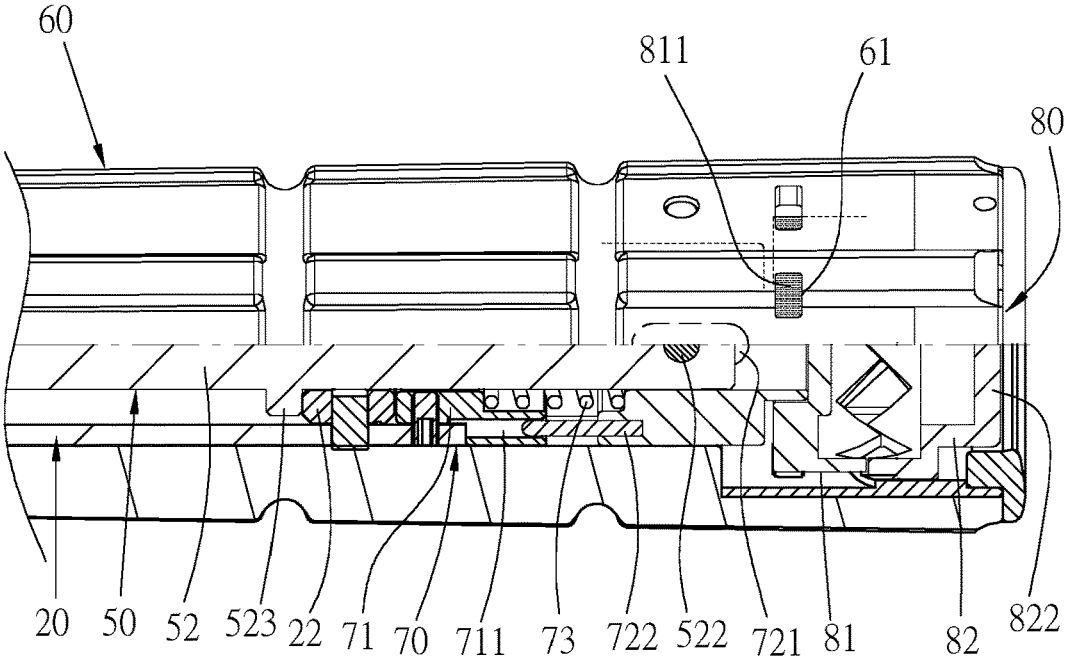
FIG. 7 is a sectional view according to FIG. 5, showing that the push unit is positioned in the locking position.

Please now refer to FIGS. 6 and 7. The locking mechanism 70 includes a fixed collar 71, a slide collar 72 and an elastic member 73. The fixed collar 71 is fixedly disposed at the rear end of the tubular body 20. Several engagement holes 711 are annularly formed on a rear end face of the fixed collar 71. The slide collar 72 is slidably disposed on the rotary rod 52 and formed with an axial slot 721. The pin 522 is inserted through the axial slot 721, whereby the slide collar 72 cannot be rotated around the rotary rod 52. When the handle 60 rotates the rotary rod 52, the slide collar 72 is synchronously rotated with the rotary rod 52. Four engagement pins 722 are disposed on the front end face of the slide collar 72. Two ends of the elastic member 73 respectively elastically abut against a rear side of the fixed collar 71 and front side of the slide collar 72, whereby when not forced, the fixed collar 71 is spaced from the slide collar 72. When the slide collar 72 is moved toward the fixed collar 71, the engagement pins 722 will be correspondingly plugged into the engagement holes 711 and locked therewith. Under such circumstance, the slide collar 72 is hindered from rotating by the fixed collar 71 so that the rotary rod 52 and the handle 60 cannot be rotated. A first identification area 723 is disposed on an outer circumference of the slide collar 72. In this embodiment, the first identification area 723 is a green section for indication. Alternatively, the first identification area 723 can be a character or a figure or any other mark with identification effect. In order to facilitate the processing, the entire fixed collar 72 can be formed with one single color by means of such as injection molding or full spraying and coloring.

The push unit 80 is disposed in the fitting collar 63 and positioned behind the slide collar 72. The push unit 80 includes an operation member 81 and a pushing member 82. A second identification area 811 is disposed on an outer circumference of the operation member 81. In this embodiment, the second identification area 811 is a red section for indication. Alternatively, the second identification area 811 can be a character or a figure or any other mark with identification effect. In order to facilitate the processing, the entire operation member 81 can be formed with one single color by means of such as injection molding or full spraying and coloring. Four raised blocks 812 and eight sharp toothed-faces 813 are disposed on an outer circumference of a rear end of the operation member 81. The raised blocks 812 are disposed on the outer side of the sharp toothed-faces 813 at intervals. Eight push blocks 821 are disposed on an outer circumference of the pushing member 82 and directed forward. The top sections of the push blocks 821 have conic configuration. A push button 822 is disposed at the bottom of the pushing member 82. The push blocks 821 are disposed on an inner side of the passages 631 and the restriction protrusion blocks 632 and axially movable within the handle 60.

Figure 8:
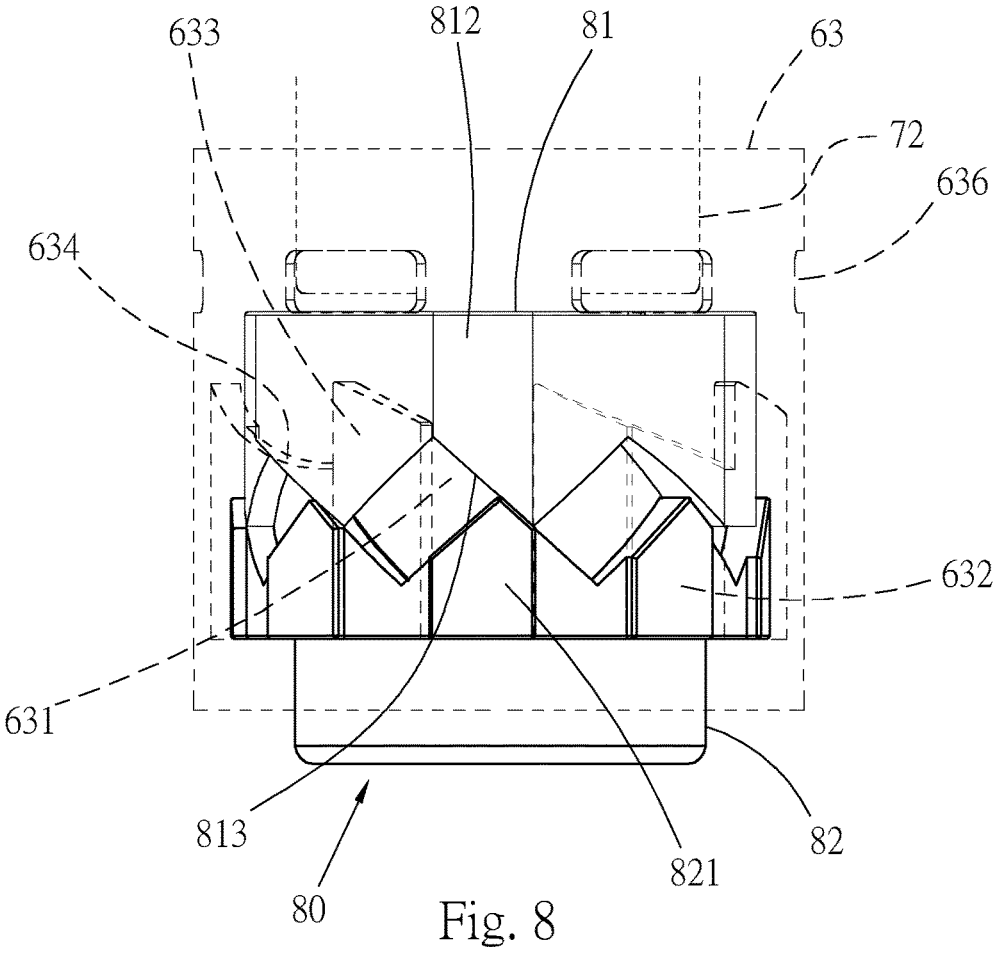
FIG. 8 is a view showing that the operation member and the pushing member of the push unit are moved into the passages.
Figure 9:
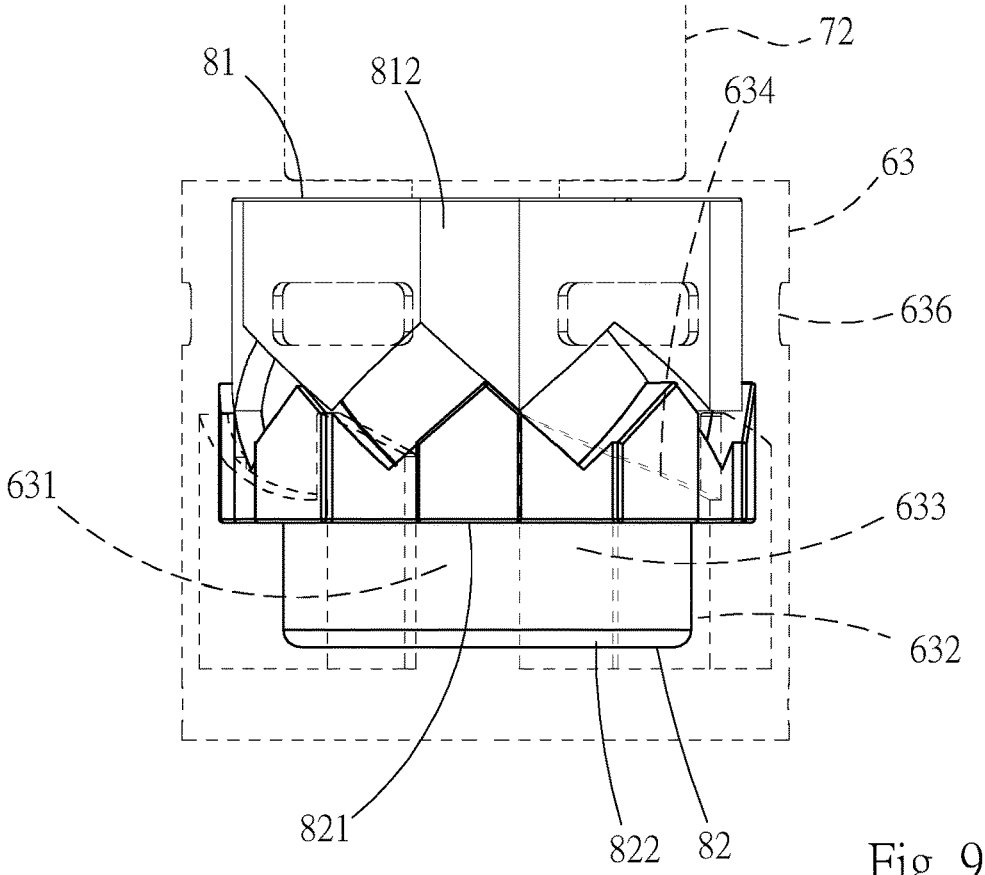
FIG. 9 is a view according to FIG. 8, showing that the operation member and the pushing member of the push unit are pushed upward.
Figure 10:
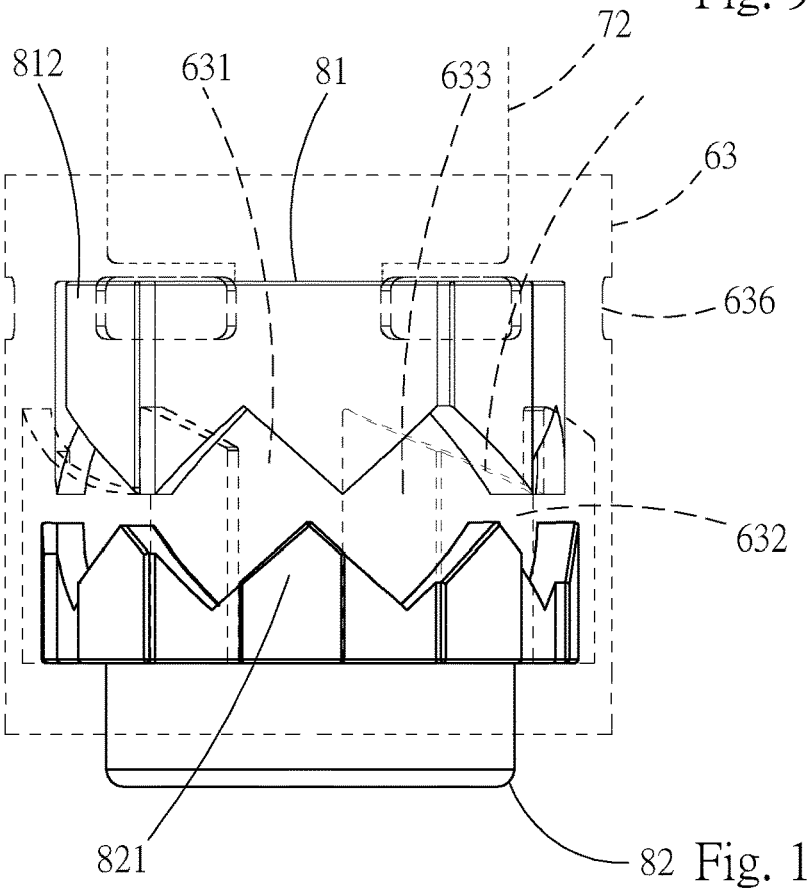
FIG. 10 is a view according to FIG. 8, showing that the operation member of the push unit is slid to the restriction protrusion blocks.

Please now refer to FIG. 6. When adjusting the torque value, a user first checks which identification area is displayed in the display window 61. In the case that the first identification area 723 is displayed, this means the locking mechanism 70 is positioned in an unlocking position and the slide collar 72 is not pushed by the push unit 80. Under such circumstance, the handle 60 can rotate the torque adjustment mechanism 50, whereby the rotary rod 52 and the slide collar 72 slidably disposed on the rotary rod 52 can be synchronously rotated. When the rotary rod 52 is rotated, the push member 51 is moved within the tubular body 20 in the axial direction thereof, whereby the position of the push member 51 in the tubular body 20 is adjusted. When the push member 51 is moved toward the front end, the elastic force of the elastic body 42 is increased so that the force applied to the click block 41 is increased. Accordingly, the force for the stem body 32 of the tool head 30 to click from the click block 41 is increased. In this case, the set torque value of the torque tool 10 is increased. Reversely, when the push member 51 is moved toward the rear side of the tubular body 20, the elastic force of the elastic body 42 is reduced so that the set torque value of the torque tool 10 is lowered. Please refer to FIG. 7. In the case that the second identification area 811 is displayed in the display window 61, this means the push unit 80 is positioned in a locking position, where the slide collar 72 is engaged and locked with the fixed collar 71. Under such circumstance, the rotary rod 52 is hindered from rotating by the slide collar 72 so that it is impossible to adjust the torque value. Please refer to FIGS. 8 to 10, in which the fitting collar 63 and the slide collar are shown by phantom lines to illustrate the operation relationship. To adjust the torque value, the pushing member 82 is first pushed to make the conic sections of the front end of the push block 821 push the sharp toothed-faces 813 of the operation member 81, whereby the rear end face of the operation member 81 becomes higher than the height of the spacer block 633. The front end of the operation member 81 is under the action of the elastic member 73 so that when the sharp toothed-faces 813 of the operation member 81 become higher than the spacer block 633, the operation member 81 will be angularly displaced to make the raised blocks 812 of the operation member 81 fall into the passage 631. At this time, the elastic member 73 will push the slide collar 72 rearward to extract the engagement pins 722 out of the engagement holes 711. Under such circumstance, the slide collar 72 is unlocked from the fixed collar 71 so that the handle 60 can drive the rotary rod 52 to freely rotate for adjusting the torque value. Please refer to FIG. 6. With the torque value adjustable, the push unit 80 is positioned in the unlocking position and the color of the first identification area 723, that is, the green color, is displayed through the display window 61. After the torque adjustment is completed, the push unit 80 is driven to the locking position. At this time, the push button 822 is pressed to move the conic section of the front end of the push block 821 forward, whereby the conic section of the front end of the push block 821 pushes the raised blocks 812 to move forward from a rear side of the passages 631. Also, the operation member 81 will push the slide collar 72 to move forward and compress the elastic member 73. After the raised blocks 812 are pushed out of the passages 631, the conic section of the front end of the push block 821 will abut against the sharp toothed-faces 813 of the rear end of the raised blocks 812, whereby the operation member 81 is displaced forward toward the slide collar 72. Also, the elastic force of the elastic member 73 will force the raised blocks 812 downward. When the rear end of the operation member 81 becomes higher than the front end of the spacer block 633, under the action of the elastic member 73, the sharp toothed-faces 813 of the rear end of the raised blocks 812 are angularly displaced to rotate toward the restriction protrusion blocks 632, whereby the raised blocks 812 are rotated toward the restriction protrusion blocks 632. The raised blocks 812 are positioned on the slopes 634 of the top ends of the restriction protrusion blocks 632, whereby the operation member 81 is slightly rearward displaced to change the position of the push unit 80 into the locking position. Further referring to FIG. 7, the operation member 81 also will push the slide collar 72 to move forward and compress the elastic member 73. Accordingly, the engagement pins 722 at the front side of the slide collar 72 will move forward to plug into the engagement holes 711 of a rear end of the fixed collar 71 and lock therewith, whereby the slide collar 72 cannot be rotated. Under such circumstance, the handle 60 and the rotary rod 52 cannot be rotated and the torque adjustment mechanism 50 is kept in the locking state. At this time, the color of the second identification area 811 on the operation member 81, that is, the red color, is displayed through the display window 61.

In use, a user can directly check whether the first identification area 723 or the second identification area 811 is displayed through the display window 61 so as to judge whether the torque adjustment mechanism 50 of the torque tool 10 is in the locking state. This can prevent the user from using the torque tool 10 with the torque adjustment mechanism 50 in an unlocking state or rotating the handle 60 to adjust the torque value with the torque adjustment mechanism 50 in a locking state.

Moreover, the fitting collar 63 is separately formed and externally connected with the handle 60. Therefore, the internal structure of the fitting collar 63 is easy to process. In addition, in the case that the handle 60 is made of a softer material such as rubber, the fitting collar 63 can be selectively made of metal material or the like material with higher strength so as to enhance the use strength thereof.

In practice, the passages 631, the restriction protrusion blocks 632, the spacer blocks 633 and the slopes 634 disposed on the inner circumference of the fitting collar 63 can be directly formed on the inner circumference of the handle 60.

In practice, the first and second identification areas can be switched in position, that is, the first identification area is disposed on the push unit, while the second identification area is disposed on the locking mechanism. Even if the positions of the display windows are adjusted or the positions of the push unit and the locking mechanism are adjusted, the first and second identification areas can be still seen through the display windows.

The structure of the present invention enables a user to directly ensure that the torque adjustment mechanism is in the locking state through the display windows. Such structure is novel and unique. Also, the adjusted torque value can be fixed to ensure the stability in use of the torque tool. This enhances the utility of the torque tool.

The above embodiments are only used to illustrate the present invention, not intended to limit the scope thereof. Many modifications of the above embodiments can be made without departing from the spirit of the present invention.

What is claimed is:

1. A torque tool for identifying locking state of torque adjustment mechanism, comprising:

a tubular body;

a tool head fitting with a front end of the tubular body, the tool head having a stem body at a rear end, the stem body being disposed in the tubular body;

a click unit disposed in the tubular body, the click unit including a click block and an elastic body, the elastic body elastically abutting against a rear side of the click block, whereby the click block abuts against a rear end of the stem body by a pre-force;

a torque adjustment mechanism disposed in the tubular body and positioned behind the elastic body, the torque adjustment mechanism being movable in an axial direction of the tubular body to adjust the elastic force of the elastic body;

a tubular handle rotatably fitted around the tubular body, at least one display window being formed on a circumference of the handle, the handle serving to drive the torque adjustment mechanism;

a locking mechanism disposed between the torque adjustment mechanism and the handle for selectively locking the torque adjustment mechanism;

a push unit disposed in the handle and positioned behind the locking mechanism, the push unit being displaceable between an unlocking position and a locking position, when the push unit is positioned in the unlocking position, the torque adjustment mechanism being not locked by the locking mechanism, when the push unit is positioned in the locking position, the push unit driving the locking mechanism to lock the torque adjustment mechanism; and a first identification area and a second identification area respectively formed on the locking mechanism and the push unit, when the push unit is positioned in the unlocking position, the first identification area being displayed through the display window, when the push unit is positioned in the locking position, the second identification area being displayed through the display window.

2. The torque tool as claimed in claim 1, wherein the first identification area is disposed on the locking mechanism, while the second identification area is disposed on the push unit.

3. The torque tool as claimed in claim 1, wherein an inner circumference of a rear end of the handle is formed with several passages and an equal number of restriction protrusion blocks, a spacer block being disposed between each passage and each restriction protrusion block, a top section of the spacer block being formed with a slope, the push unit including an operation member and a pushing member, the second identification area being formed on an outer circumference of the operation member, several raised blocks being disposed on an outer circumference of the operation member, the number of the raised blocks being equal to the number of the passages, several sharp toothed-faces being disposed at a rear end of the operation member, the number of the sharp toothed-faces being double the number of the raised blocks, the raised blocks being disposed on an outer side of the sharp toothed-faces at intervals, several push blocks being disposed on an outer circumference of the pushing member, the number of the push blocks being double the number of the passages, top sections of the push blocks having conic sections corresponding to the sharp toothed-faces, the push blocks being correspondingly slidably disposed on an inner side of the passages and the restriction protrusion blocks and restricted therein, the top sections of the push blocks being longitudinally reciprocally movable to push the sharp toothed-faces.

4. The torque tool as claimed in claim 3, further including a fitting collar is formed of a socket, an inner circumference of the fitting collar being formed with several passages and several restriction protrusion blocks, several spacer blocks being disposed between the passages and the restriction protrusion blocks, at least one slide channel being concavely formed on an inner circumference of a rear end of the handle, a slide rib being convexly disposed on an outer circumference of the fitting collar corresponding to the slide channel, whereby the fitting collar can be slidably located at the rear end of the tubular handle, several assistant display windows being formed through the fitting collar, whereby after the fitting collar is assembled with the handle, the assistant display windows are in alignment with the display windows.

5. The torque tool as claimed in claim 1, wherein the first and second identification areas are identified by colors.

6. The torque tool as claimed in claim 1, wherein the first and second identification areas are identified by characters.

7. The torque tool as claimed in claim 1, wherein the torque adjustment mechanism includes a rotary rod and a push member, a pin being inserted through a rear end of the rotary rod, whereby the handle can drive the rotary rod via the pin, the push member being screwed with a front end of the rotary rod, a front side of the push member abutting against a rear side of the elastic body, whereby when rotating the rotary rod, the push member is axially displaced within the tubular body to adjust the elastic force of the elastic body.

8. The torque tool as claimed in claim 7, wherein a guide slot is formed on an outer circumference of the tubular body and extends in the axial direction of the tubular body, a guide block being disposed on an outer circumference of the push member, the guide block being restricted within the guide slot.

9. The torque tool as claimed in claim 7, wherein a restriction section protrudes is concavely disposed in the inner circumference of a rear end of the tubular body, a restriction ring is convexly disposed on the rotary rod corresponding to the restriction section, whereby the restriction section restricts the axial move of the restriction ring within the tubular body.

10. The torque tool as claimed in claim 7, wherein the locking mechanism includes a fixed collar and a slide collar, the fixed collar being fixedly disposed at the rear end of the tubular body, the slide collar being slidably disposed on the rotary rod, the slide collar being formed with an axial slot, the pin being inserted through the axial slot of the slide collar, whereby the rotating direction of slide collar is restricted and can only move in the axial direction of the rotary rod, an elastic member being disposed between the fixed collar and the slide collar to elastically abut against the fixed collar and the slide collar, whereby when there is no external force, the fixed collar and the slide collar are spaced from each other, when the slide collar is moved toward the fixed collar, the slide collar is restricted from rotating by the fixed collar so that the rotary rod is locked by the slide collar and hindered from rotating, the first identification area being disposed on an outer circumference of the slide collar.

11. The torque tool as claimed in claim 10, wherein several engagement holes are annularly formed on the fixed collar and at least one engagement pin protrudes from the slide collar corresponding to the engagement holes.

* * * * *